United States Patent [19]

Wobser, II

[11] Patent Number: 4,932,135

[45] Date of Patent: Jun. 12, 1990

[54] CHALKLINE STRING HOLDER

[76] Inventor: Robert L. Wobser, II, 207 Williams St., Huron, Ohio 44839

[21] Appl. No.: 350,393

[22] Filed: May 11, 1989

[51] Int. Cl.[5] ..... B43L 13/00

[52] U.S. Cl. ..... 33/408; 33/410

[58] Field of Search ..... 33/407, 408, 409, 410, 33/413, 414

[56] References Cited

U.S. PATENT DOCUMENTS

| | | | |
|---|---|---|---|
| 2,508,076 | 5/1950 | Palmer | 33/410 |
| 2,659,973 | 11/1953 | Patzel | 33/410 |
| 2,893,125 | 7/1959 | Kampel | 33/407 |
| 2,919,489 | 1/1960 | Espinosa | 33/410 |
| 3,148,453 | 9/1964 | Di Carlo | 33/410 |
| 3,751,810 | 8/1973 | Valva | 33/410 |

*Primary Examiner*—Harry N. Haroian

*Attorney, Agent, or Firm*—Marshall & Melhorn

[57] ABSTRACT

There is provided a chalkline string holder for positioning and anchoring the free end of a chalkline string, thereby allowing a single operator to pay-out, stretch, and snap the chalkline string without assistance from another.

10 Claims, 1 Drawing Sheet

CHALKLINE STRING HOLDER

FIELD OF THE INVENTION

This invention relates generally to chalkline string holders, and more particularly, to a device for positioning and anchoring the free end of a chalkline string, thereby allowing the chalkline string to be snapped by a single operator.

BACKGROUND OF THE INVENTION

The common practice for snapping a chalkline string as is currently known in the construction industry involves the participation of two individuals. One person holds the free end of the chalkline string at a predetermined position, representing the terminus of a chalk line to be applied on for example the surface of a wall or floor. The other person proceeds to the desired location for the opposite terminus of the chalk line, paying-out the chalkline string from a conventional chalkline string box. The chalkline string is thereafter "snapped," causing a quantity of the chalk contained in the chalkline string to adhere to the surface against which it is snapped.

The aforementioned procedure has several disadvantages. In many instances, a second individual is not available to assist in snapping a chalkline string. For the case in which a second individual is available, that person must stop whatever he is doing and assist the chalkline box operator in applying the chalk line. This, of course, results in reduced productivity, especially where the second individual is working quite a distance from the desired chalk line location. In the case where the second individual is working at an elevated location, such as on a ladder or scaffold, there is an increased risk of injury associated with his descent and ascent in order to assist in snapping the chalkline string.

Construction industry personnel have attempted to minimize productivity and safety losses associated with this operation. One method has been for the individual to attach the free end of the chalkline string to the surface upon which the chalk line is to be placed, utilizing a nail or other anchoring device. This could result in the anchoring device falling off or shifting away from the predetermined mark when tension is applied to the chalkline, especially when angled lines are desired, thereby resulting in an inaccurate chalk line mark. Furthermore, the surface against which the chalkline string is to be snapped may not be amenable to a penetrating anchoring device. For example, a nail could not easily be driven into the surface of a concrete floor, or a nail pressed into foam insulation wallboard could not secure the free end of a chalkline string when the chalkline string is placed under tension.

U.S. Pat. No. 2,589,500 discloses a conventional chalkline box, including a ring at the free end of the chalkline which is intended to be placed over a nail or penetrating anchor placed into the surface against which the chalkline string is to be snapped.

U.S. Pat. No. 3,675,735 discloses mounting means for positioning and anchoring the free end of a chalkline string, utilizing a spring-loaded rod mounted on a ladder. Such a device is limited in its usefulness to the application of chalk lines only at locations accessible by a ladder.

Finally, U.S. Pat. No. 4,731,933 discloses a chalkline box in combination with a protractor. The device is useful for accurately snapping angled chalk lines, but still requires the participation of a second person to accurately locate and anchor the free end of the chalkline.

It would be desirable to construct a simple chalkline holding device, which would permit an individual to quickly and accurately apply a chalk line to a surface without assistance from another. Such a device should be inexpensive, easy to use, and adjustable for use on a wide variety of surfaces and for placing chalk lines at various angles.

SUMMARY OF THE INVENTION

Accordant with the present invention, there has surprisingly been discovered a chalkline holder, for positioning and anchoring the free end of a chalkline, comprising: a chalkline string holder comprising:

(A) a first bracket including
1. a main body portion having opposite ends,
2. means for receiving a chalkline string at one end of the main body portion, and
3. a surface engaging portion integral with the one end of the main body portion and disposed normal thereto;

(B) a second bracket including
1. a main body portion having opposite ends, and
2. a surface engaging portion integral with one end of the main body portion and disposed normal thereto; and (C) means for selectably securing the first bracket to the second bracket to effect a predetermined distance between the surface engaging portions of said first and second brackets.

The device is useful for positioning and anchoring the free end of a chalkline string, thereby allowing the application of a chalk line to a surface by a single operator.

BRIEF DESCRIPTION OF THE DRAWINGS

The novel features that are considered characteristic of the invention are set forth with particularity in the appended claims. The invention itself, however, both as to structure and method of use, will best be understood from the accompanying description of specific embodiments, when read in connection with the attendant drawings, in which:

DETAILED DESCRIPTION OF THE PREFERRED EMBODIMENT

Figure 1:
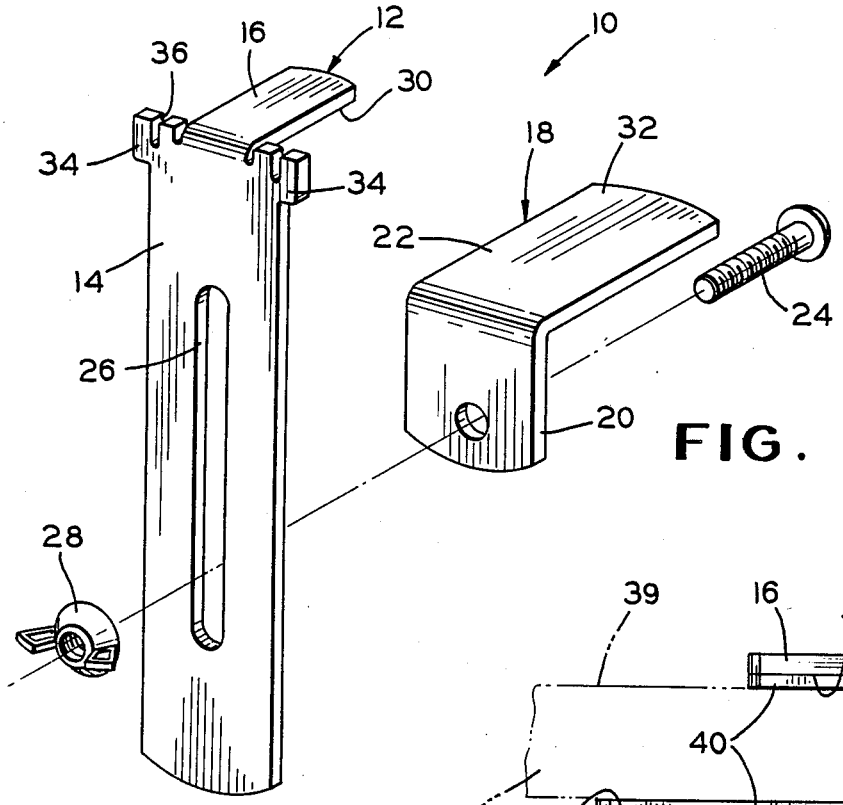
FIG. 1 is a perspective exploded view of a chalkline holder embodying the features of the present invention.

Referring now to FIG. 1, there is shown generally at 10 a chalkline string holder embodying the features of the present invention. The holder 10 comprises a first generally L-shaped bracket 12, including a first planar portion 14 and a second planar portion 16, a second generally L-shaped bracket 18, including a first planar portion 20 and a second planar portion 22, and means for securing the L-shaped brackets 12 and 18 together. The first planar portion 14 and second planar portion 16 of the first L-shaped bracket 12 are disposed substantially at right angles to each other, and may conveniently be formed from an appropriately stamped piece of flat metal stock which is subsequently bent at approximately a 90° angle. Likewise, the first planar portion 20 and second planar portion 22 of the second L-shaped bracket 18 may be formed from a single appropriately shaped piece of metal flat stock which is subsequently bent at approximately 90°. The term "planar portion", as the term is used herein, is also contemplated to include structures having square or round as well as rectangular cross sectional configurations; i.e., the planar portions may be in the form of bars or rods.

The securing means comprises a threaded fastener such as a bolt 24 adapted to extend through an aperture in the first planar portion 20 of the second L-shaped bracket 18, and thence through a slot 26 formed in the first planar portion 14 of the first L-shaped bracket 12. A wing nut 28 may be received by the bolt 24 and tightened to militate against relative movement between the L-shaped brackets 12 and 18.

The slot 26 provides adjustability for the holder 10, allowing the second planar portions 16 and 22 to be moved toward or away from each other before the wing nut 28 is tightened to thereby secure the first planar portions 14 and 20 adjacent one another and thereby prevent relative movement between the associated brackets 12 and 18. This adjustability allows the holder 10 to be clamped onto a structure, by moving the second planar portions 16 and 22 toward each other until the engaging surfaces 30 and 32 of the second planar portions 16 and 22, respectively contact the structure. It must be understood that other clamping means may be employed to adjustably secure the first planar portions 14 and 20 adjacent one another, e.g. a frictionally operated ratchet device, or the like.

In the preferred embodiment, tabs 34 are formed to extend away from the first planar portion 14 of the first bracket 12, and have formed therein notches 36 for receiving a chalkline string. The embodiment of FIG. 1 illustrates the holder 10 as having two tabs 34, one on each side of the planar portion 16. Each tab 34 is provided with a notch 36 formed therein. However, it must be understood that a holder 10 having only one tab 34 with one notch 36 could also be utilized to achieve the objectives of the invention.

Figure 2:
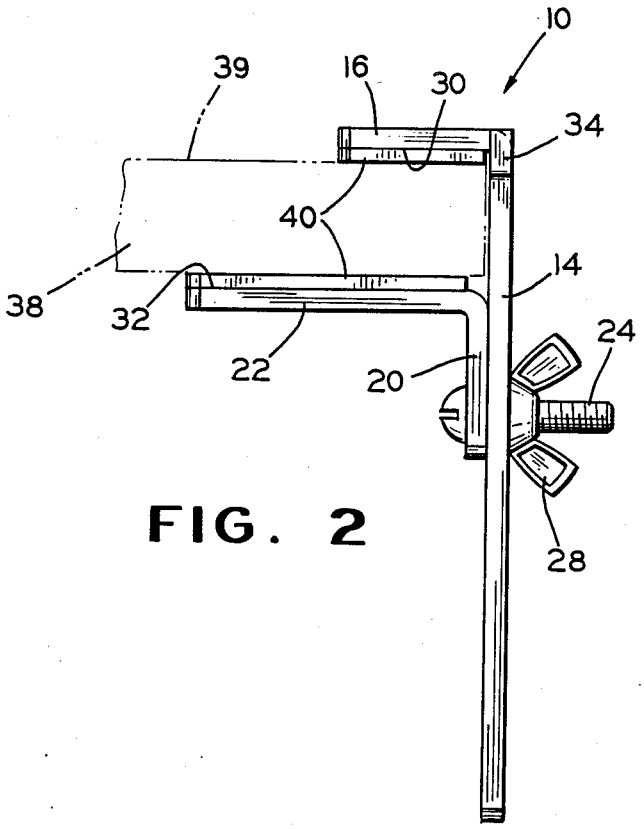
FIG. 2 is a side elevational view of the chalkline holder of FIG. 1, illustrating the holder clamped onto a supporting surface on which a chalk line string is to be snapped.

Referring now to FIG. 2, there is shown the chalkline holder 10 of FIG. 1 affixed to a structure 38, upon a surface 39 of which a chalk line is to be struck. The holder 10 is clamped to the structure 38 utilizing the procedure described hereinabove. Additionally, there is shown a set of pads 40, which may optionally be affixed to the engaging surfaces 30 and 32 of the second planar portions 16 and 22, respectively, utilizing a conventional adhesive. The pads 40 are conveniently made of, for example, a rubbery material such as neoprene or EPDM rubber, and are intended to frictionally prevent movement of the holder 10 relative to the structure 38.

In operation, the holder 10 is affixed to a structure 38 utilizing the clamping procedure described hereinabove. The holder 10 is positioned, in relation to the structure 38, so as to locate a notch 36 substantially at a terminus of the desired chalk line. Thereafter, the free end of a chalkline string (not shown) is wound around and secured to the exposed portion of the bolt 24, passed through the predetermined notch 36 in the appropriate tab 34, and the chalkline string is payed-out along the surface 39 of the structure 38 upon which the chalk line is to be struck. The chalkline string may be payed-out at any angle away from the holder 10 lying substantially in the plane of the second planer member 16 of the first bracket 12. The operator may then stretch the chalkline, by applying tension at the end near the chalkline box, and snap the chalkline string. At all times during the snapping operation, the free end of the chalkline string is caused to remain anchored and properly positioned at a single point on the surface 39 of the substrate 38, as determined by the notch 36 engaging the free end of the chalkline string.

Figure 3:
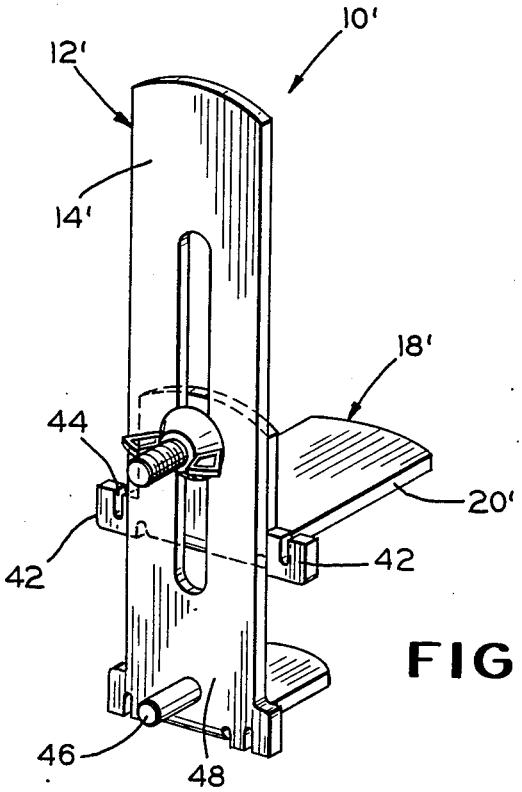
FIG. 3 is a perspective view of an alternative embodiment of a chalkline string holder, showing positioning notches on both L-shaped brackets.

In FIG. 3, there is shown an alternative embodiment of the holder 10, including tabs 42 extending away from the first planar portion 20' of the second bracket 18'. Each tab 42 has a notch 44 formed therein for receiving a chalkline. Contemplated as having the same operability and utility is the holder 10' of FIG. 3, including only one tab 42 having a single notch 44 formed therein.

Also shown in FIG. 3 is a pin 46 projecting outwardly from and normal to an outer surface 48 (opposite a surface adjacent the second bracket 18') of the first planar member 14' of the first bracket 12'. In operation, the embodiment of FIG. 3 is utilized in the same manner as the holder 10 of FIGS. 1 and 2, excepting that the free end of the chalkline is wrapped around and secured to the pin 46 before being passed through the appropriate notch 44.

The invention is more easily comprehended by reference to the specific embodiments described hereinabove, which are representative of the invention. It must be understood, however, that the specific embodiments are provided for the purposes of illustration and understanding, and that the invention may be practiced otherwise than as specifically illustrated without departing from its spirit and scope.

What is claimed:

1. A chalkline string holder, for positioning and anchoring the free end of a chalkline string, comprising:

(A) a first generally L-shaped bracket, including a first planar portion, a second planar portion extending at substantially a right angle away from the first planar portion, and at least one tab extending away from and coplanar with the first planar portion, the tab having formed therein at least one notch for receiving a chalkline string;

(B) a second generally L-shaped bracket, including a first planar portion, and a second planar portion extending at substantially a right angle away from the first planar portion; and (C) means for securing the first planar portions of said first and second brackets adjacent one another, for preventing relative movement therebetween, said securing means including pin-like means projecting outwardly beyond and normal to an outer surface of said first planar portion of said first bracket in the direction opposite said second planar portion thereof for anchoring said free end of said chalkline string thereto.

2. The chalkline string holder according to claim 1, wherein said securing means includes:

(A) a bolt extending through an aperture formed in the first planar portion of said second bracket, thence through a slot formed in the first planar portion of said first bracket; and (B) a nut for threadably engaging said bolt.

3. The chalkline string holder according to claim 1 wherein the first bracket includes a plurality of said tabs.

4. The chalkline string holder according to claim 1, including pads affixed to facing surfaces of the second planar portions of said first and second brackets.

5. A chalkline string holder for positioning and anchoring the free end of a chalkline string comprising:

(A) a first generally L-shaped bracket including a first planar portion, a second planar portion extending at substantially a right angle away from the first planar portion, at least one tab extending away from and coplanar with the first planar portion, the tab having formed therein a notch for receiving a chalkline, and a pin projecting outwardly from and normal to an outer surface of the first planar portion;

(B) a second generally L-shaped bracket, including a first planar portion, a second planar portion extending at substantially a right angle away from the first planar portion, and at least one tab extending away from and coplanar with the first planar portion and having formed therein a notch for receiving a chalkline string; and (C) means for securing the first planar portions of the first and second brackets adjacent one another for preventing relative movement therebetween.

6. The chalkline string holder according to claim 5 wherein the securing means includes:

(A) a bolt extending through an aperture formed in the first planar portion of said second bracket, thence through a slot formed in the first planar portion of said first bracket; and (B) a nut for threadably engaging the bolt.

7. The chalkline string holder according to claim 5 wherein said first bracket includes a plurality of tabs.

8. The chalkline string holder according to claim 5 wherein said second bracket includes a plurality of tabs.

9. The chalkline string holder according to claim 5 including pads affixed to engaging surfaces of the second planar portions of said first and second brackets.

10. A chalkline string holder for positioning and anchoring the free end of a chalkline string comprising:

(A) a first generally L-shaped bracket, including a first planar portion, a second planar portion extending at substantially a right angle away from the first planar portion, a plurality of tabs extending away from and coplanar with the first planar portion, the tabs having formed therein a notch for receiving a chalkline string, and a pin projecting outwardly from and normal to an outer surface of the first planar portion;

(B) a second generally L-shaped bracket including a first planar portion, a second planar portion extending at substantially a right angle away from the first planar portion, and a plurality of tabs extending away from and coplanar with the first planar portion, the tabs having formed therein a notch for receiving a chalkline string;

(C) means for securing the first planar portions of said first and second brackets adjacent one another for preventing relative movement therebetween including:

(i) a bolt extending through an aperture formed in the first planar portion of said second bracket, thence through a slot formed in the first planar portion of said first bracket; and (ii) a nut for threadably engaging the bolt; and (D) pads affixed to engaging surfaces of the second planar portions of said first and second brackets.

* * * * *